United States Patent [19]
Thornburg et al.
[11] 4,251,296
[45] Feb. 17, 1981

[54] METHOD OF PREPARING AN ORIENTED-LOW-ALLOY IRON FROM AN INGOT OF CONTROLLED SULFUR, MANGANESE AND OXYGEN CONTENTS

[75] Inventors: Donald R. Thornburg, Forest Hills; Gary C. Rauch, Murrysville; Karl Foster, Forest Hills, all of Pa.

[73] Assignee: Westinghouse Electric Corp., Pittsburgh, Pa.

[21] Appl. No.: 38,360

[22] Filed: May 11, 1979

[51] Int. Cl.[3] ..... H01F 1/00
[52] U.S. Cl. ..... 148/120; 148/31.55; 148/111; 75/123 L; 75/126 R
[58] Field of Search ..... 148/111, 120, 110, 112, 148/31.55; 75/126 R, 123 L

[56] References Cited

U.S. PATENT DOCUMENTS

| | | | |
|---|---|---|---|
| 1,965,559 | 7/1934 | Goss | 148/111 |
| 3,218,202 | 11/1965 | Ganz | 148/111 |
| 3,849,212 | 11/1974 | Thornburg | 148/31.55 |
| 3,892,605 | 7/1975 | Thornburg | 148/120 |

OTHER PUBLICATIONS

"Development of (110)[001] Texture Low Alloy Iron by Primary Recrystallization and Normal Grain Growth", vol. 8A, Jan. 1977, Metallurgical Trans.
"Magnetic Properties of (110)[001] Oriented Low Alloy Iron", American Institute of Physics Conference Proceedings-21 Annual Conference-Philadelphia, 1975.

*Primary Examiner*—L. Dewayne Rutledge
*Assistant Examiner*—John P. Sheenan
*Attorney, Agent, or Firm*—R. A. Stoltz

[57] ABSTRACT

This invention is of a process and an intermediate alloy for making an oriented-low-alloy iron (primarily recrystallized) which obtains maximum (110) [001] texture and improved magnetic properties by controlling the sulfur, carbon, manganese, and oxygen contents in the intermediate alloy to certain critical narrow ranges. With alloys containing the 0.01–0.15 percent manganese normally found in commercially available iron, the optimum intermediate (prior to final anneal) sulfur level has been found to be 0.004–0.008 percent. This sulfur level is appropriate for such manganese contents for a wide variety of silicon and chromium content. Similarly an intermediate carbon level of between 0.002 and 0.020% has been shown to give the maximum texture and best properties. The oxygen level must be 0.005 percent or lower and should be held as low as practicable. With these levels of sulfur, carbon, manganese, and oxygen, the alloy can be processed by hot rolling at 900°–1200° C. (usually between 1000°–1100° C.), followed by either two or three cold rolling stages with the final cold rolling providing a 50–75 percent reduction, and with annealing at between 750° C. and the $A_{C1}$ temperature of the material between cold rollings. The alloy can also contain 0–3% cobalt and up to total of 2% chromium and silicon.

5 Claims, 2 Drawing Figures

METHOD OF PREPARING AN ORIENTED-LOW-ALLOY IRON FROM AN INGOT OF CONTROLLED SULFUR, MANGANESE AND OXYGEN CONTENTS

CROSS REFERENCE TO RELATED APPLICATIONS

An oriented-low-alloy iron with high initial sulfur content is described in related application Ser. No. 038,359 filed concurrently by the same inventors and assigned to the same assignee. This related application utilizes an ingot which has high sulfur levels (0.012–0.020 percent) and is substantially free of manganese. Such higher sulfur content reduces melting cost, but requires a more extensive final anneal.

An oriented-low-alloy iron with certain narrow ranges of silicon and chromium is described in related application Ser. No. 038,361 filed concurrently by the same inventors and assigned to the same assignee. This related application may be (but need not necessarily be) practiced with the sulfur, manganese, carbon, and oxygen levels described herein.

BACKGROUND OF THE INVENTION

This invention relates to an iron based alloy which, when processed in accordance with the method as set forth herein, will produce an oriented grain structure in the finished product which is characterized by a cube-on-edge orientation or as described in Miller indices as (110) [001] grain orientation, and having a primary recrystallized and normal grain growth microstructure. Such magnetic materials are useful, for example, as core materials, in power and distribution transformers.

The operating inductions of a large portion of today's transformers are limited by the saturation value of the magnetic sheet material which forms the core. In extensive use today is an iron-based alloy containing nominally 3.25 percent silicon (all composition percentages herein are weight percent) which is processed in order to obtain cube-on-edge or (110) [001] grain orientation in the final product. An example of this well-known steel depending upon the final magnetic characteristics is called type M-5 and has the final grain orientation developed by means of a secondary recrystallized microstructure. This microstructure is attained during the final box annealing in which preferentially oriented grains grow at the expense of non-preferentially oriented grains with the result that the alloy usually has an extremely large grain structure size in which the diameter greatly exceeds the thickness of the sheet material. Obtaining such large grains in a secondarily recrystallized microstructure requires a long time, high temperature anneal for the development of the orientation. The anneal is also required for the removal of residual sulfur content. Sulfur contents in excess of about 100 ppm in the finished product adversely affect the magnetic characteristics exhibited by the silicon-iron alloy.

In addition to the costly, long-time, high-temperature anneal, the addition of 3.25 percent silicon to pure iron, while effective and generally desirable for improving the volume resistivity, nevertheless lowers the saturation value so that in most commercially produced 3.25% silicon containing iron alloys, the saturation value of such alloys is usually less than about 20,300 gauss. Thus there is the obvious trade-off between the improved resistivity (which lowers core losses of the material) that is obtained at the expense of saturation value (significantly lower than the saturation value of about 21,500 gauss for commercially pure iron). Moreover, since commercial iron has substantially higher core losses and substantially higher coercive force values than silicon steel, it was prudent to balance the overall magnetic characteristics and the best balance heretofore obtained was that of the 3.25 -percent-silicon iron alloy which exhibited the cube-on-edge orientation.

An alternative by a primary recrystallization method to the generally used commercial alloy is described in U.S. Pat. No. 3,849,212, issued Nov. 19, 1974, and the associated primary recrystallation method of U.S. Pat. No. 3,892,605, issued July 1, 1975 (both to Thornburg) relating to an iron base alloy from an ingot containing up to about 0.03 percent carbon, up to 1 percent manganese, from about 0.3 to about 4 percent of at least one of the volume resistivity improving elements selected from the group consisting of up to about 2 percent silicon, up to 2 percent chromium, and up to about 3 percent cobalt. The balance of the alloy is essentially iron with incidental impurities. Thornburg's method utilizes processing by hot working and either a two- or three-stage cold rolling operation, with the final cold rolling stage effecting only a moderate (50–75 percent) reduction in the cross-sectional area of the material being processed. These prior patents deal in relatively broad ranges of composition and do not recognize the criticality between constituents.

SUMMARY OF THE INVENTION

Figure 1:
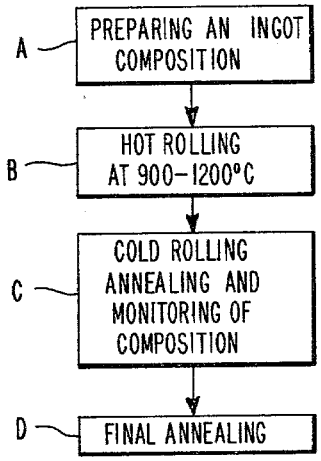
FIG. 1 is a flow diagram of a method of processing this material.

The present invention relates to an iron-based alloy prepared utilizing an intermediate alloy (the alloy in its intermediate product form prior to final anneal) containing 0.004–0.008% sulfur, 0.01–0.15 percent manganese, 0.002–0.020% carbon, 0–0.005% oxygen, 0–3% cobalt, up to 2% of at least one of the elements selected from the group consisting of silicon and chromium with the balance being essentially iron with incidental impurities. The method comprises preparing an ingot generally of the above composition, but with 0.002–0.100% carbon content, and hot rolling the ingot in the gamma range (usually between 900°–1200° C. and preferably about 1000°–1100° C.) generally followed by three cold rolling stages with the final cold rolling providing a 50–75 percent reduction. Intermediate annealing (the first for generally about 1–5 hours and the second generally for 1–24 hours) at between 750° C. and the $A_{C1}$ temperature of the material is performed between cold rolling stages. The carbon content of the intermediate alloy is generally controlled by (at least in initially setting up the production procedure) monitoring the carbon content prior to the last intermediate anneal and making any necessary adjustments in conditions (e.g. in the time and/or temperature of the last intermediate anneal) to control the carbon content to the desired 0.002–0.020% range. After the final cold rolling, the material is final annealed in the same temperature range but generally for about 24–72 hours. When materials of the above-described narrow ranges of composition is processed as described herein, a material having improved textures and magnetic properties results.

DESCRIPTION OF THE PREFERRED EMBODIMENT

The above-noted Thornburg patents show that good (110) [001] texture can be obtained with many iron-based alloys with the addition of silicon and/or chromium and/or cobalt in alloys containing substantially no manganese and at least possibly having little or no sulfur. It has now been discovered that alloys containing commercial levels of manganese (0.01–0.15 percent) can produce alloys with very good orientation and magnetic properties if a certain critical range of sulfur content (0.004–0.008 percent) is used. Experiments have also shown that there is an optimum range of carbon and a maximum oxygen content that dictate the degree of texture formation and subsequent magnetic characteristics in low alloy iron.

The processing of these alloys can be done with either two or three cold rolling stages. In the two-stage process the material is, for example, hot rolled at about 1050° C. to a thickness of about 0.100 inches (0.254 cm), cleaned (e.g. by pickling) and then cold rolled to about 0.020 inches (0.050 cm), annealed for about 1–5 hours at 850° C. and then given a final cold roll to about 0.006 inch (0.015 cm) thickness. The three-stage process, for example, uses hot rolling to about 0.180 inches (0.46 cm), cleaning, annealing for 1–5 hours at 850° C., cold rolling it to about 0.080 inches (0.20 cm), annealing for 1–5 hours at 850° C., cold rolling it to about 0.020 inches (0.050 cm), annealing for about 1 hour at 850° c. and cold rolling it to about 0.006 inches (0.015 cm). The final cold roll in both the two- and three-stage process is followed by a final anneal at, for example, 900° C. for 48 hours.

All annealing steps of this invention are to be in an inert or reducing atmosphere, and preferably in dry hydrogen. In addition, as used herein, the term cold rolling is used to include rolling at any temperature from room temperature up to 300° C.

The effectiveness of sulfur content is as shown by a series of experiments with alloys having a nominal 0.8 percent silicon, 0.6 percent chromium, and 0.015 percent carbon, and with varying amounts manganese and sulfur. After processing to 0.006 inch by the three-stage process with a final anneal of 48 hours at 900° C. (heated and cooled at rates of 50° C. per hour) the magnetic properties described in Table 1 were obtained.

TABLE 1

| Alloy No. | % Mn | % S | $H_c$ (Oe) | $B_{10}$ (kG) | $P_{c15/60}$ (W/lb) | $P_{c17/60}$ (W/lb) |
|---|---|---|---|---|---|---|
| SB203 | 0.01 | 0.0011 | 0.164 | 17.8 | 0.74 | 0.90 |
| SB206 | 0.15 | 0.0011 | 0.159 | 18.2 | 0.66 | 0.81 |

TABLE 1-continued

| Alloy No. | % Mn | % S | $H_c$ (Oe) | $B_{10}$ (kG) | $P_{c15/60}$ (W/lb) | $P_{c17/60}$ (W/lb) |
|---|---|---|---|---|---|---|
| SB208 | 0.02 | 0.0058 | 0.146 | 19.2 | 0.53 | 0.71 |
| SB191 | 0.04 | 0.0058 | 0.157 | 19.3 | 0.53 | 0.71 |
| SB190 | 0.14 | 0.0057 | 0.167 | 19.3 | 0.56 | 0.70 |
| SB212 | 0.02 | 0.012 | 0.245 | 16.0 | 0.91 | — |
| SB200 | 0.05 | 0.013 | 0.313 | 16.5 | 0.87 | — |
| SB218 | 0.13 | 0.014 | 0.374 | 17.5 | 0.87 | 1.23 |

The data of Table 1 shows that only alloys with a 0.005 percent sulfur addition have $B_{10}$ (Induction in a 10 Oersted field) values above 19 kG (kilogauss) and very low 17 kG losses. Alloys with no sulfur addition have significantly lower $B_{10}$ values and higher $P_c$ values (core loss at 15 and 17 kilogauss at 60 Hertz in watts per pound), while alloys with 0.012 percent sulfur or higher have very low $B_{10}$ values and high $H_C$ (coercive force in Oersteds) values and losses.

In another investigation, a larger number of alloys having nominal sulfur contents of 0 percent, 0.005 percent, and 0.015 percent were evaluated. These alloys have silicon contents of 0.3–1.2 percent, chromium contents of up to 1.2 percent, manganese contents of 0.15–0.30 percent, and 0.015 percent carbon. They were processed by either two- or three-stage processes and given a 48 hour final anneal at 900° C. in the same manner as the alloys of Table 1. The average properties obtained are shown below in Table 2.

TABLE 2

| Nominal % S | 3-Stage Process $H_c$ (Oe) | 3-Stage Process $B_{10}$ (kG) | 2-Stage Process $H_c$ (Oe) | 2-Stage Process $B_{10}$ (kG) |
|---|---|---|---|---|
| 0 | 0.297 | 17.8 | 0.222 | 17.2 |
| 0.005 | 0.193 | 19.4 | 0.224 | 18.1 |
| 0.015 | 0.401 | 17.9 | 0.489 | 16.6 |

For both the two-stage and three-stage processes the alloys containing 0.005 percent sulfur had higher $B_{10}$ values (and better texture) than either the alloys with no sulfur addition or the alloys with 0.015 percent sulfur. These results indicate that there is an optimum range for best texture development in low alloy iron with normal commercial manganese content. Good performance was given with sulfur contents of about 0.004–0.008%, and the preferred range is 0.005–0.006 percent sulfur.

The carbon effect was studied in alloys with carbon contents of nominally 0 percent, 0.015 percent, and 0.030 percent. These alloys also contain 0.15–0.30 percent manganese and 0.005 percent of sulfur. Each type of alloy was processed by both two-and three-cold rolling stage processes and annealed 48 hours at 900° C. with the results summarized in Table 3 below.

TABLE 3

| Alloy No. | Nominal % Si | Nominal % Cr | Nominal % C | 3-Stage Process $H_c$ (Oe) | 3-Stage Process $B_{10}$ (kG) | 3-Stage Process $P_{c17/60}$ (W/lb) | 2-Stage Process $H_c$ (Oe) | 2-Stage Process $B_{10}$ (kG) | 2-Stage Process $P_{c17/60}$ (W/lb) |
|---|---|---|---|---|---|---|---|---|---|
| SB125 | 0.6 | 0.6 | 0 | 0.239 | 18.6 | 0.89 | 0.370 | 16.0 | 1.48 |
| SB128 | 1.2 | 0.6 | 0 | 0.206 | 18.9 | 0.77 | 0.345 | 16.1 | 1.35 |
| SB117 | 0.6 | 0.6 | 0.015 | 0.189 | 19.7 | 0.78 | 0.230 | 18.3 | 0.88 |
| SB126 | 0.3 | 0.6 | 0.015 | 0.206 | 19.3 | 0.81 | 0.252 | 18.3 | 0.98 |
| SB134 | 0.6 | 0.3 | 0.015 | 0.189 | 19.6 | 0.76 | 0.225 | 18.4 | 0.89 |
| SB136 | 0.6 | 0.6 | 0.015 | 0.191 | 19.5 | 0.75 | 0.221 | 18.2 | 0.88 |
| SB121 | 0.6 | 0.6 | 0.030 | 0.229 | 17.7 | 0.96 | 0.328 | 16.1 | 1.37 |
| SB127 | 1.2 | 0.6 | 0.030 | 0.218 | 17.8 | 0.90 | 0.328 | 16.0 | 1.27 |

It can be seen from Table 3, that for the three-stage process, only alloys with a nominal 0.015% carbon have $B_{10}$ values consistently have 19 kG, and 17 kG,losses are low for these alloys. Alloys with no carbon addition have slightly lower $B_{10}$ values for this process, while alloys with a 0.030% carbon addition have considerably lower $B_{10}$ values and higher losses. For the two-stage process, only the 0.015% carbon alloys have $B_{10}$ values above 18 kG. The 0 percent and 0.030 percent carbon alloys have considerably lower $B_{10}$ values and much higher 17 kG losses. These results together with associated experiments indicate that the optimum intermediate carbon level for maximum texture development is between about 0.002 and 0.020 percent.

It should be noted that while other levels remain essentially constant from the ingot stage to the intermediate alloy stage, the carbon can be removed from these alloys during processing by decarburization annealing. The intermediate alloy can be processed carefully (e.g. as described above) from an ingot of proper carbon composition without substantially changing the carbon level or it can be brought into the proper range (e.g. by controlled decarburizing at 0.080 inch thickness prior to further processing) from a higher ingot carbon level. Whatever the process, monitoring of intermediate carbon level is essential at least on process start-up and at least periodic (if not continuous) monitoring during process operation is highly desirable.

While ingot carbon contents in the range 50–200 ppm produce better texture and lower core loss than ingot carbon contents outside this range, such low ingot carbon levels are difficult to obtain with the low oxygen contents without adding aluminum, which interferes with the development of the desired texture. It is therefore desirable to use alloys with higher ingot carbon contents, the carbon being controllably reduced at an appropriate intermediate stage as required to promote proper texture formation.

Twelve different three-stage processing schedules were studied. In each, slab ingots were hot rolled at 1050° C. to 0.180 inch thick, cleaned, annealed, cold rolled to 0.080 inch, annealed, cold rolled to 0.020 inch, annealed, cold rolled to 0.006 inch, and final annealed at 900° C. for 48 h, with heating and cooling at 50° C./h. All anneals were performed in dry $H_2$, with dew point less than −40° C. Both box anneals and continuous strip anneals were included. For the box anneals, individual strips were separated to give free access of the $H_2$ to all surfaces as in an open-coil anneal. Seven different alloys were used, with compositions shown below in Table 4.

TABLE 4

| Heat | Composition Weight Percent | | | | | | |
|---|---|---|---|---|---|---|---|
| No. | % Si | % Cr | % Mn | % S | % C | % O | % N |
| VM1695 | .77 | .41 | .10 | .0070 | .029 | .0026 | .0003 |
| VM1696 | .78 | .39 | .10 | .0075 | .016 | .0022 | .0002 |
| VM1697 | .80 | .41 | .10 | .0073 | .008 | .0018 | .0002 |
| VM1740 | .88 | <.03 | .07 | .0061 | .009 | .0020 | <.0002 |
| VM1741 | .88 | <.03 | .08 | .0064 | .020 | .0012 | .0002 |
| VM1742 | .87 | <.03 | .08 | .0062 | .029 | .0011 | <.0002 |
| VN1779 | ~.90 | ~.60 | ~.08 | .0043 | .015 | .0023 | .0013 |

The series VM1695-1697 comprises alloys with almost identical Si, Cr, Mn, S, and O contents with three different carbon levels, including one higher than the optimum range 0.005–0.020%. Similarly, VM1740-1742 are Cr-free with one of the three carbon levels being again high. VM1779 is an alloy fully optimized for the processing schedules used previously.

After these alloys were processed by the twelve different schedules, peak magnetic torque was measured to determine the degree of texture. All specimens with peak torques greater than 180,000 dyne.cm/cm$^3$ had peak ratios 0.50, indicating a predominant (110) [001] texture component.

Figure 2:
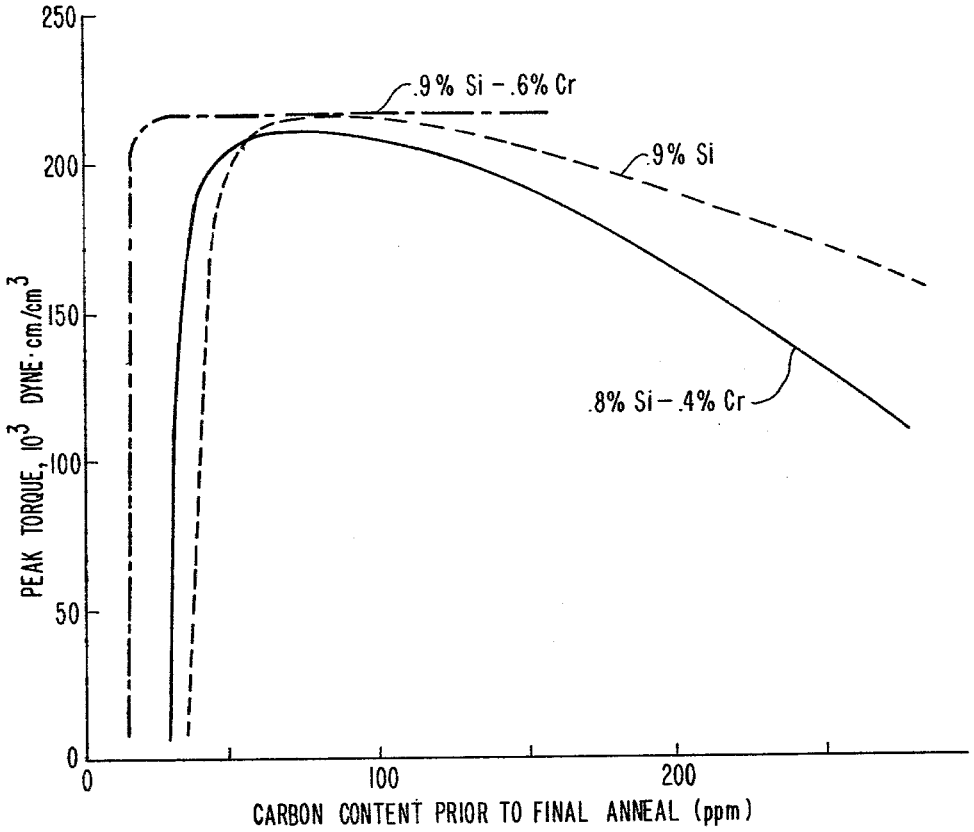
FIG. 2 is a graph illustrating the criticality of carbon content prior to final anneal.

Several of the alloys and processes yielded peak magnetic torques greater than 210,000 dyne.cm/cm$^3$, which corresponds approximately to a $B_{10}$ value of 19.0 kG. However, some schedules produced inferior texture. Despite the variety of processes studied, final texture was found to be strongly correlated with carbon content prior to the final anneal, and independent of the initial (ingot) carbon content. This is shown in FIG. 2.

For the 0.8% Si-0.4% Cr alloys, carbon content prior to the final anneal are in the range 40–150 ppm for best texture, while a 0.9% Si alloys perform best if the carbon is 50–220 ppm. The optimized 0.9% Si-0.6% Cr alloy generally yielded excellent texture for all greater than 20 ppm carbon levels which were evaluated.

The essential point is that controlling the carbon to the correct range prior to the final anneal yields excellent texture even in alloys with higher ingot carbon contents.

Heats MV1695 and VM 1742 are representative of alloys with higher ingot carbon which can nonetheless be successfully processed using appropriate mill-practical schedules. As an example, the carbon content of VM1695 was reduced from 290 ppm (ingot analysis) to 260 ppm (analyzed after the anneal at the 0.020 inch stage) by a three-stage process using 2 min-900° C. continuous strip anneals at all stages. The resultant final peak torque was only 109,000 dyne.cm/cm$^3$. When a 24 h-800° C. open coil box anneal was substituted at the 0.080 inch stage, the carbon remaining after anneal of the 0.020 inch material was 50 ppm, and the final peak torque was 207,000 dyne,cm/cm$^3$. Thus excellent texture can be obtained in an alloy with 290 ppm ingot carbon using a practical three-stage process in which continuous strip anneals are used at the hot band and 0.020 inch stages and an open coil box anneal is used at the 0.080 inch stage.

Heat VM 1742 also had an ingot carbon content of 290 ppm. When this alloy was processed using 2 min-900° C. continuous strip anneals at all three intermediate stages, the carbon content was reduced only to 260 ppm after the anneal at the 0.020 inch stage. The final peak torque was only 155,000 dyne.cm/cm$^3$. When 5 hr.-850° C. open-coil box anneals were substituted for the continuous strip anneals at hot band and 0.080 inch stages, the carbon remaining after the anneal at 0.020 inch was 100 ppm, and the final peak torque was 198,000 dyne,cm/cm$^3$.

The effect of oxygen content on texture development was studied using three alloys having nominal 0.8 percent silicon, 0.6% chromium, 0.15% manganese, 0.006 percent sulfur, and 0.014 percent carbon. These alloys were rolled to 0.006 inch thickness using two- and three-stage processes, final annealed for 48 hours at 900° C., and gave the properties summarized in Table 5.

TABLE 5

| | | 3-Stage | | | 2-Stage | | |
|---|---|---|---|---|---|---|---|
| Alloy No. | % O | $H_c$ (Oe) | $B_{10}$ (kG) | $P_{c17/60}$ (W/lb) | $H_c$ (Oe) | $B_{10}$ (kG) | $P_{c17/60}$ (W/lb) |
| SB219 | 0.0006 | 0.17 | 19.4 | 0.66 | 0.20 | 17.7 | 0.89 |

TABLE 5-continued

| Alloy No. | % O | 3-Stage $H_c$ (Oe) | 3-Stage $B_{10}$ (kG) | 3-Stage $P_{c17/60}$ (W/lb) | 2-Stage $H_c$ (Oe) | 2-Stage $B_{10}$ (kG) | 2-Stage $P_{c17/60}$ (W/lb) |
|---|---|---|---|---|---|---|---|
| SB220 | 0.0020 | 0.19 | 18.8 | 0.79 | 0.23 | 17.2 | 1.00 |
| SB221 | 0.0031 | 0.21 | 18.5 | 0.82 | 0.25 | 17.1 | 1.04 |

The data of Table 5 shows that there is a decrease in $B_{10}$ values and an increase in $H_C$ and 17 kG losses with increasing oxygen content for both processes. The 17 kG loss value is much lower for the 0.0006% oxygen alloy of the three-stage process. These and related experiments show that oxygen content for texture development in low alloy iron should be maintained below 0.005 percent, and is preferably maintained below 0.002 percent.

Thus it can be seen that in such oriented low-alloy iron, the intermediate alloy levels of sulfur, carbon, and oxygen content must be carefully controlled in order to maintain the maximum (110) [001] texture and improved magnetic properties. Regardless of the processing procedure, the optimum intermediate sulfur levels for alloys with 0.01–0.15% manganese is 0.004–0.008%. An intermediate stage carbon level of between 0.002–0.020% gave the best properties and maximum texture. With 0.75–0.85% silicon and 0.3–0.5% chromium, 0.004–0.015% carbon is preferred. With 0.85–0.95% silicon and 0–0.1% chromium, 0.004–0.020% carbon is preferred. With 0.85–0.95% silicon and 0.5–0.7% chromium, 0.002–0.020 % carbon is used. In all alloys and processes, the oxygen level should be as low as practical considerations will allow.

The invention is not to be construed as limited to the particular forms described herein, since these are to be regarded as illustrative rather than restrictive. The invention is intended to cover all processes which do not depart from the spirit and scope of the invention.

What we claim is:

1. A primary recrystallization method of preparing an oriented-low-alloy iron suitable for use as transformer core material, said method comprising:

(a) preparing an ingot alloy consisting essentially of 0.01–0.15 percent manganese, 0.004–0.008 percent sulfur, 0.002–0.100 percent carbon, 0–0.005 percent oxygen, 0–3 percent cobalt and up to 2 percent of at least one of the elements selected from the group consisting of silicon and chromium, with the balance being essentially iron;

(b) hot rolling said alloy at 900°–1200° C.;

(c) a first cold rolling;

(d) controlling the carbon content to 0.002–0.020 percent by a carbon-level-controlling anneal at between 750° C. and the $A_{C1}$ temperature of the material;

(e) cold rolling said alloy to final thickness; and (f) final annealing said alloy at between 750° C. and the $A_{C1}$ temperature of the material.

2. The method of claim 1, wherein said oxygen content is below 0.002 percent.

3. The method of claim 2, wherein said carbon level is about 0.015 percent.

4. The method of claim 2, wherein the sulfur content is between 0.005 and 0.006 percent.

5. The method of claim 2, wherein said anneal following said first cold rolling is for 1–5 hours and said anneal following said additional cold rolling is for 1–24 hours and said final annealing is for 24–72 hours.

* * * * *